US010865670B2

(12) United States Patent
Dudar

(10) Patent No.: US 10,865,670 B2
(45) Date of Patent: Dec. 15, 2020

(54) ENGINE VARIABLE OIL PUMP DIAGNOSTIC METHOD

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 364 days.

(21) Appl. No.: 15/792,693

(22) Filed: Oct. 24, 2017

(65) Prior Publication Data

US 2019/0120096 A1 Apr. 25, 2019

(51) Int. Cl.

*F01M 1/18* (2006.01)
*F01M 1/16* (2006.01)
*F01M 1/02* (2006.01)

(52) U.S. Cl.

CPC ..... *F01M 1/18* (2013.01); *F01M 1/16* (2013.01); *F01M 2001/0238* (2013.01); *F01M 2001/0246* (2013.01); *F01M 2250/60* (2013.01)

(58) Field of Classification Search

CPC .... F01M 1/18; F01M 1/16; F01M 2001/0238; F01M 2001/0246; F01M 2250/60

See application file for complete search history.

(56) References Cited

U.S. PATENT DOCUMENTS

| | | | | |
|---|---|---|---|---|
| 6,044,822 A * | 4/2000 | Daniels | F01M 1/02 | 123/196 R |
| 6,763,797 B1 * | 7/2004 | Staley | F04C 14/226 | 123/196 R |
| 7,665,352 B2 * | 2/2010 | Staley | G01M 3/32 | 73/114.57 |
| 7,674,095 B2 * | 3/2010 | Hunter | F04C 2/102 | 417/220 |
| 7,726,948 B2 * | 6/2010 | Hunter | F01M 1/16 | 417/213 |
| 8,734,122 B2 * | 5/2014 | Murray | F01M 1/20 | 417/212 |
| 8,739,746 B2 * | 6/2014 | Bidner | F01M 11/10 | 123/41.15 |
| 2011/0209682 A1 * | 9/2011 | Storch | F01M 1/02 | 123/196 R |
| 2019/0120096 A1 * | 4/2019 | Dudar | F01M 1/16 | |
| 2019/0195095 A1 * | 6/2019 | Dudar | F01M 1/02 | |
| 2019/0242279 A1 * | 8/2019 | Dudar | F01M 1/20 | |

* cited by examiner

*Primary Examiner* — Michael A Riegelman
(74) *Attorney, Agent, or Firm* — Geoffrey Brumbaugh; McCoy Russell LLP

(57) ABSTRACT

Methods and systems are provided for indicating degradation of a variable displacement oil pump. In one example, an engine method comprises indicating degradation of the oil pump based on a fuel usage change of the engine, responsive to a commanded change in displacement of the variable oil pump. In response to an indicated degradation, engine wear may be avoided and fuel economy may be improved by adjusting engine operation.

8 Claims, 5 Drawing Sheets

ENGINE VARIABLE OIL PUMP DIAGNOSTIC METHOD

FIELD

The present description relates generally to a variable displacement oil pump and more particularly to a method for diagnosing the functioning of the variable displacement oil pump.

BACKGROUND/SUMMARY

An internal combustion engine typically includes a lubrication circuit comprising an oil pump. The oil pump is mechanically connected to and driven off of the engine crankshaft such that the output flow of the oil pump is directly linked to the crankshaft rotation speed. Traditionally, oil pumps have been fixed displacement pumps, typically having an oversized configuration to ensure a sufficient supply of oil at low speeds when the pump is turning slowly as well as at high speeds when the pump is turning faster. Thus, fixed displacement pumps displace a fixed oil volume for each turn of the crankshaft, thereby ensuring proper lubrication of moving engine parts at low and high engine speeds. However, given a range of engine speeds, the oil displacement may be higher than desirable by the engine, leading to inefficient use of engine power. For example, at high engine speeds, a high rate of oil pump rotation due to increased crankshaft rotation speed over-delivers oil supply. The excess oil is typically dealt with via a release valve that routes the excess oil to the engine sump. Ultimately, a pumping loss is incurred when the oil pump displaces more oil volume than required by the engine.

In order to minimize penalties from pumping losses and reduce fuel consumption, oil pumps in recent internal combustion engines may be variable displacement oil pumps (VDOP). VDOP configurations may include vane type pumps wherein solenoid control valves may control the length of the vanes to adjust oil displacement and in some examples oil pressure, reducing the parasitic load on the engine crankshaft during high engine speeds and ultimately saving fuel. Such VDOPs may alternate between a high displacement mode and a low displacement mode of operation to deliver a desired volume of oil, based on engine operating conditions such as engine speed and torque. For example, during low displacement mode of the VDOP at high engine speeds, the solenoid control valve may be activated to adjust the VDOP into the low displacement mode such that the VDOP does not provide excess oil, thereby minimizing pumping losses, reducing fuel consumption and increasing fuel economy. In the high displacement mode at low engine speeds, the solenoid control valve may be deactivated to return the VDOP to the high displacement mode such that the VDOP displaces a larger oil volume to compensate for the slower oil pump speeds and thus deliver suitable oil volume for engine protection. However, in some instances the VDOP may not switch between displacement modes, but instead may be stuck in a given displacement. If the VDOP is stuck in the low displacement mode, for example, insufficient oil may be delivered to the engine during low engine speed conditions, increasing engine wear and potentially causing engine degradation. For this reason, vehicles may be configured to execute diagnostics for detecting whether the variable displacement oil pump is displacing a suitable oil volume when adjusted to a given displacement mode, responsive to engine needs.

One example approach for diagnosing a VDOP operation is shown by Murray et al. In U.S. Pat. No. 8,734,122B2. Here, the switching of states of a variable flow oil pump may be determined based on differences in oil pressure sensed by an oil pressure sensor. The variable flow oil pump may switch from a low flow to a high flow state during changes in engine speed and load for example, and the ensuing changes in oil pressure may be measured by the oil pressure sensor. Based on a comparison of expected and observed pressure changes, the diagnostic oil pressure sensor may indicate when the variable flow oil pump does not switch states, as dictated by engine needs.

However, the inventors herein have recognized potential issues with such systems. As one example, the engine oil pressure sensor used to diagnose the functioning of the variable displacement oil pump may malfunction, leading to false diagnosis of pump faults. Further, in the event of a malfunctioning oil pressure sensor being identified, there is a need for an alternative approach for diagnosing the functioning of the VDOP.

In one example, the issues described above may be addressed by a method including indicating degradation of a variable displacement oil pump during vehicle steady-state operation based on a fuel usage change of the engine, upon a commanded change in pump displacement. In this way, a reliable diagnosis of the functioning of the VDOP may be made and degradation of the pump may be determined.

In one example, switching of the variable oil pump between high and low displacement modes during steady-state operation of a vehicle may result in an expected and measurable change in fuel usage by the vehicle. The variable oil pump may be commanded to switch oil displacement modes by actuation of a solenoid of the oil pump. The variable displacement oil pump may first be operated in a low displacement mode via an active solenoid and may then be commanded to a high displacement mode by deactivating the solenoid. Upon solenoid deactivation and the switching of displacement modes by the VDOP, a change in fuel usage may be determined and a resulting change in the fuel economy of the vehicle may be calculated. If the calculated fuel economy reflects (e.g., changes with) the currently operating oil flow displacement mode (e.g., high flow displacement at low speeds and low flow displacement at high speeds), then the VDOP may be functioning as expected. However, if the calculated fuel economy remains unaffected, despite the switch in pump displacement, degradation of the VDOP may be indicated and an operator may be notified that the pump stuck is in a displacement mode. Further, if the pump is diagnosed as being stuck in the low flow displacement mode, idle engine speed may be raised to mitigate engine wear.

The present disclosure may offer several advantages. For example, the diagnostic method disclosed herein may eliminate the need for additional sensors and/or equipment used to diagnose a functioning vs. A stuck (in a given displacement mode) variable flow oil pump. Upon detecting a degraded variable oil pump, an operator of the vehicle may be notified to avoid degradation of engine components resulting from undesired engine oil displacement. The method may be used additionally or alternatively to an oil pressure sensor in a vehicle for determining the functionality of a variable oil pump. Further, engine efficiency may be increased by actively controlling variable oil flow displacement from the variable displacement oil pump, thereby eliminating pumping losses and improving vehicle fuel economy.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
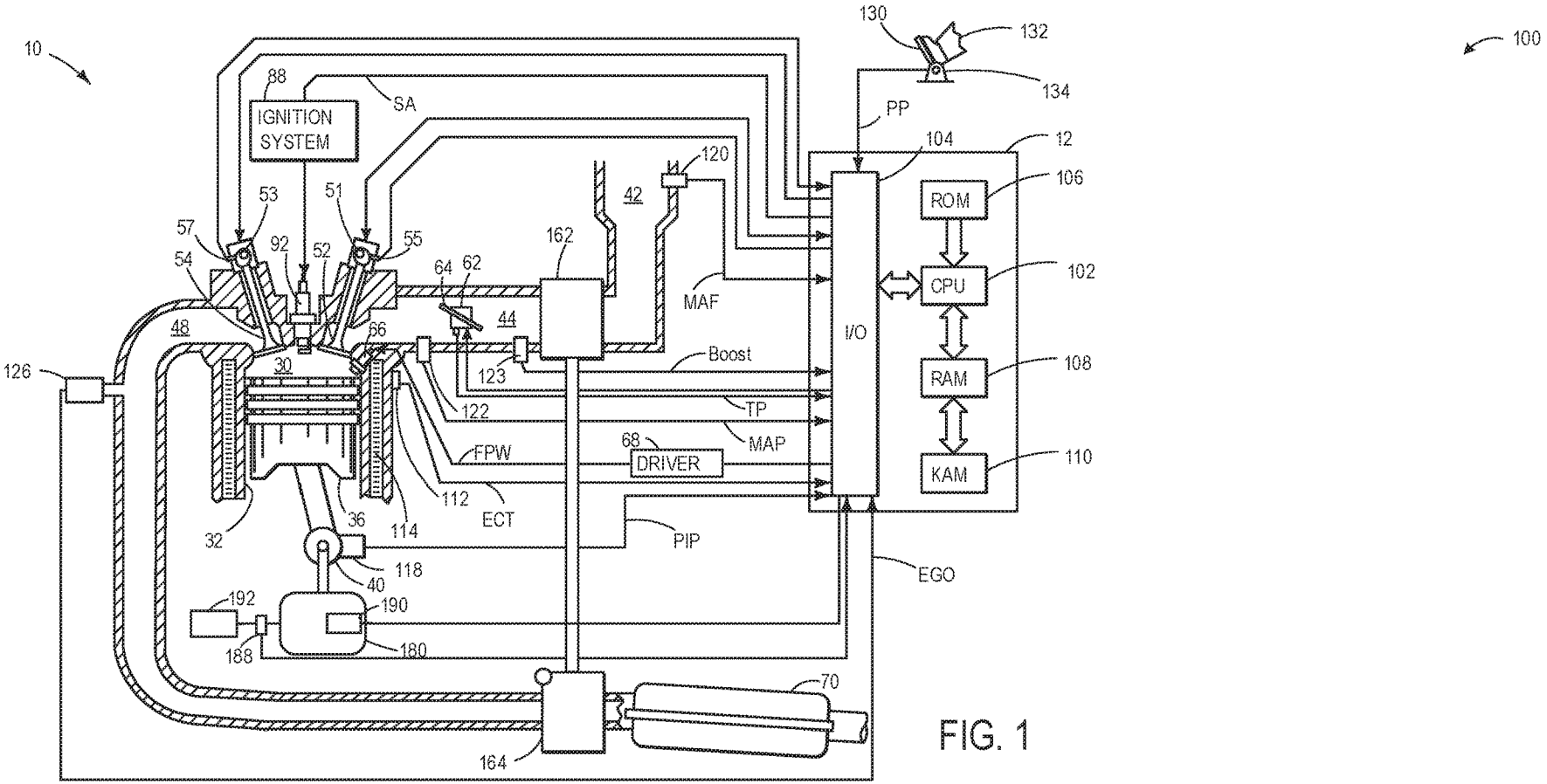
FIG. 1 shows a schematic diagram of an example engine.

The following description relates to methods for diagnosing the functioning of a variable displacement oil pump (VDOP), included in an example engine illustrated in FIG. 1. The VDOP may function to provide oil flow to the engine in accordance with a routine illustrated in FIG. 2, in a manner that is optimized for efficient engine operation, thereby improving vehicle fuel economy. An engine controller of the vehicle may be configured to perform an example routine to indicate degradation of the variable oil pump. In an example, a diagnostic routine illustrated in FIG. 3 may be performed. In order to diagnose the oil pump, the VDOP may be commanded to switch oil displacement modes via manipulation of a solenoid and the resulting changes in fuel economy may be indicative of pump degradation.

Figure 4:
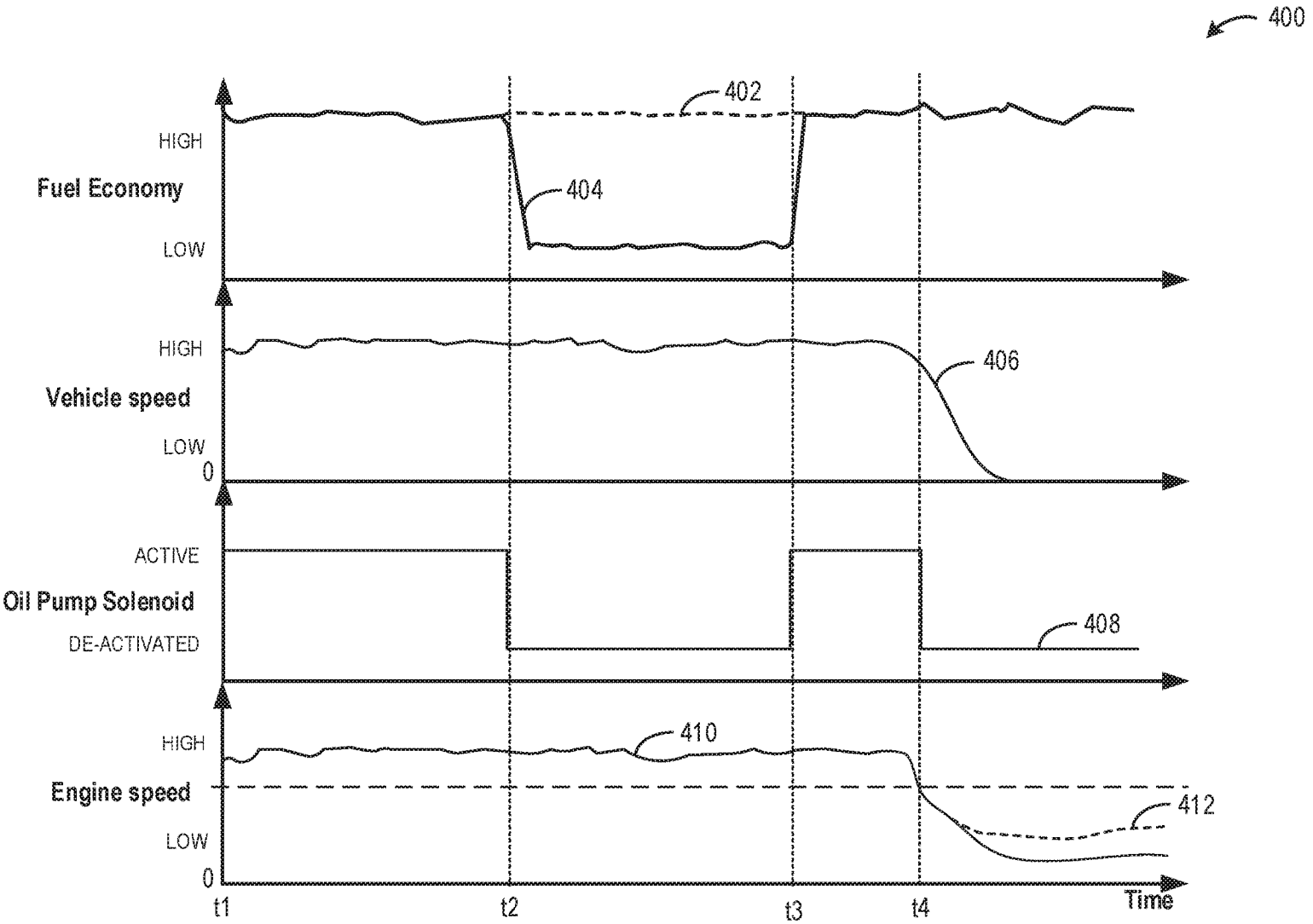
FIG. 4 shows a first graphical example of operating parameters during a diagnosis of a variable displacement oil pump based on fuel economy.
Figure 5:
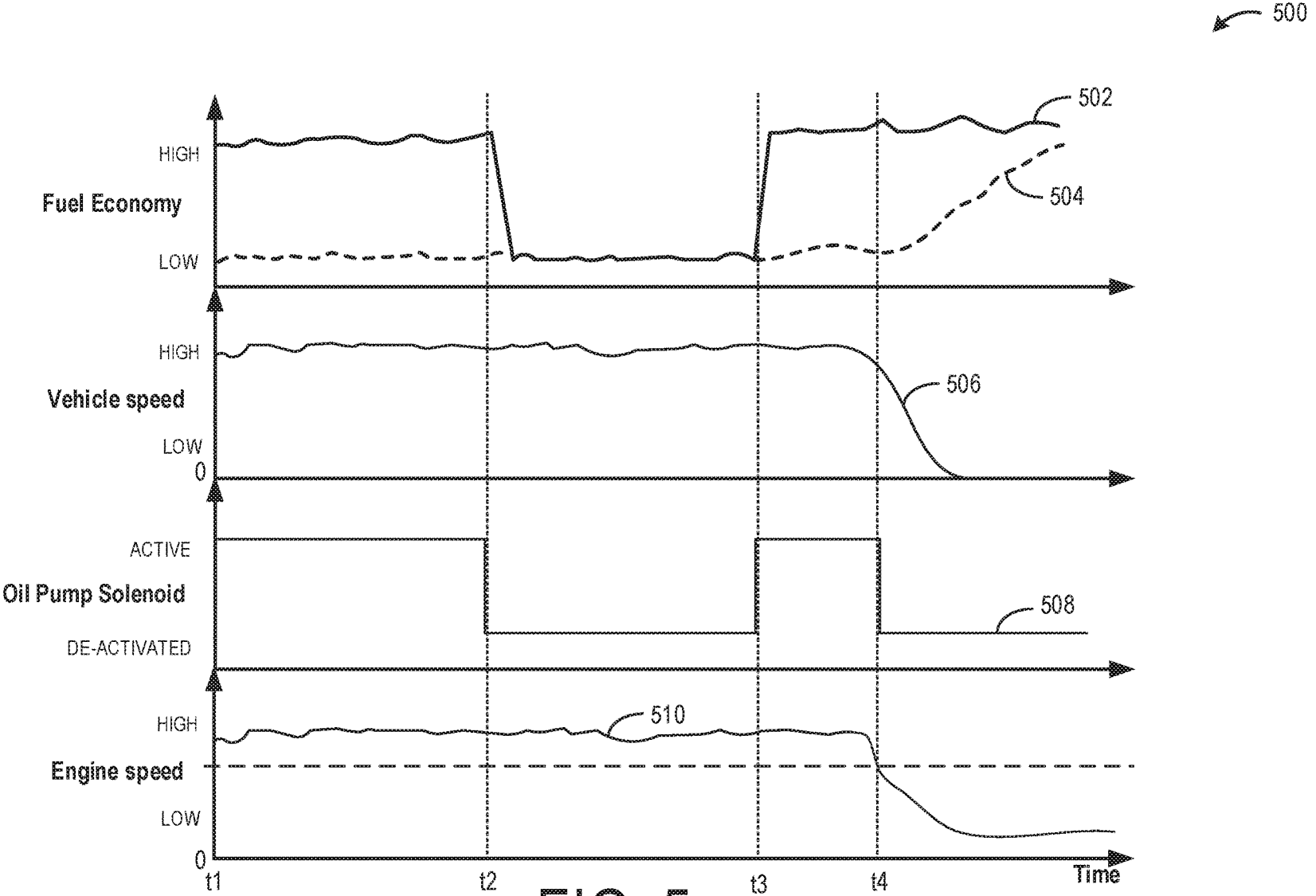
FIG. 5 shows a second graphical example of operating parameters during a diagnosis of a variable displacement oil pump based on fuel economy.

In a first example, the VDOP may be commanded to operate in a low displacement mode via activation of a solenoid, at high engine speeds under steady-state operation. A controller of the vehicle may calculate a resulting first fuel economy when the VDOP is operating with low displacement. The first fuel economy calculated for the vehicle at steady-state conditions with the VDOP in the low displacement mode may be similar to equal to a baseline fuel economy, when the oil pump is functional. The baseline fuel economy may be determined by the vehicle controller during vehicle operating conditions comprising vehicle speed above a threshold vehicle speed (e.g., above 55 MPH) and the engine operating at steady-state speed and/or load. During steady-state operation comprising one or more of vehicle speed and engine load changing by less than a respective threshold amount, a change in displacement of the VDOP may be commanded. For example, the VDOP may be switched to a high displacement mode by deactivating the solenoid, and a second fuel economy may be calculated. Mode switching by the oil pump may result in an expected change (e.g., a decrease) in the second fuel economy of the vehicle from both the baseline fuel economy and the first fuel economy calculated as shown by FIG. 4, for a non-degraded oil pump. However, if the calculated second fuel economy remains unchanged (e.g., does not decrease), despite the commanded change in pump displacement, the VDOP is determined to be stuck in either the low displacement mode or the high displacement mode. Further, if the determined first fuel economy is found to be within a threshold of the baseline fuel economy, the VDOP may be confirmed as stuck in the high displacement mode, as shown in FIG. 4, otherwise the VDOP may be confirmed as being stuck in the low displacement mode, as shown by FIG. 5.

Referring now to FIG. 1, it includes a schematic diagram showing one cylinder of a multi-cylinder internal combustion engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion cylinder 30 of engine 10 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion cylinder 30 may receive intake air from intake manifold 44 via intake passage 42 and may exhaust combustion gases via exhaust passage 48. Intake manifold 44 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. In some embodiments, combustion cylinder 30 may alternatively or additionally include a fuel injector arranged in intake passage 42 in a configuration that provides what is known as port injection of fuel into the intake port upstream of combustion cylinder 30.

Intake passage 42 may include a charge motion control valve (CMCV) 74 and a CMCV plate 72 and may also include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Variable flow oil pump 180 may be coupled to crankshaft 40 to provide rotary power to operate the variable flow oil pump 180. In one example, the variable flow oil pump 180 includes a plurality of internal rotors and associated vanes (not shown) that are eccentrically mounted. At least one of the internal rotors may be coupled to a spring that is configured to be actuated by a solenoid 190 that is controlled by controller 12. When displaced by the solenoid, the spring may cause the internal rotors to pivot relative to one or more other rotors, resulting in variable length vanes, thereby adjusting an output flow rate and oil pressure from the variable flow oil pump 180. The variable flow oil pump 180 may selectively provide oil to an engine oil gallery 192 which supplies oil to various regions and/or components of engine 10 to provide cooling and lubrication. The output flow rate or oil pressure of the variable flow oil pump 180 may be adjusted by the controller 12 to accommodate varying operating conditions to provide varying levels of cooling and/or lubrication. Further, the oil pressure output from the variable flow oil pump 180 may be adjusted to reduce oil consumption and/or reduce energy consumption by the variable flow oil pump 180.

It will be appreciated that a suitable variable flow oil pump configuration may be implemented to vary the oil pressure and/or oil flow rate. In some embodiments, instead of being coupled to the crankshaft 40, the variable flow oil pump 180 may be coupled to a camshaft, or may be powered by a different power source, such as a motor or the like. The variable flow oil pump 180 may include additional components not depicted in FIG. 1, such as a hydraulic regulator.

Exhaust gas sensor 126 is shown coupled to exhaust passage 48 upstream of exhaust aftertreatment device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. Exhaust aftertreatment device 70 may include a gasoline particulate filter (GPF) and one or more emission control devices, such as a three way catalyst (TWC) coupled together or separately (explained in more detail below with respect to FIG. 2). In other embodiments, the one or more emission control devices may be a NOx trap, various other emission control devices, or combinations thereof. In some embodiments, during operation of engine 10, emission control device 70 may be periodically reset by operating at least one cylinder of the engine within a particular air-fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. The controller 12 may receive various signals and information from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from pressure sensor 122. Storage medium read-only memory 106 can be programmed with computer readable data representing instructions executable by processor 102 for performing the method described below as well as variations thereof. The controller 12 receives signals from the various sensors of FIG. 1 and employs the various actuators of FIG. 1 to adjust engine operation based on the received signals and instructions stored on a memory of the controller.

The controller 12 may adjust operation of the variable flow oil pump 180 in response to various operating conditions, such as engine speed. The controller 12 may operate the variable displacement oil pump 180 by activation of solenoid 190. Controller 12 may activate solenoid 190 at high engine speeds, in one example. When activated, solenoid 190 may displace a spring actuator (not shown) which may cause internal rotors of the variable oil pump to pivot resulting in variable length vanes, thereby adjusting the pump to flow a low oil volume to the engine. Conversely, at low engine speeds, controller 12 may return the solenoid to its default position by deactivating it, such that the oil pump may displace a high oil volume to the engine. In other examples, the controller 12 may adjust operation of the variable flow oil pump 180 in response to the engine being in boosted vs. Non-boosted conditions (e.g., when compressed air is diverted to the engine, the variable flow oil pump 180 may be controlled to increase output. Controller 12 may also receive an indication of oil pressure from pressure sensor 188 positioned downstream of the output of the variable flow oil pump 180. The oil pressure indication may be used by the controller 12 to control adjustment of oil pressure by varying oil flow rate output from the oil pump.

Figure 2:
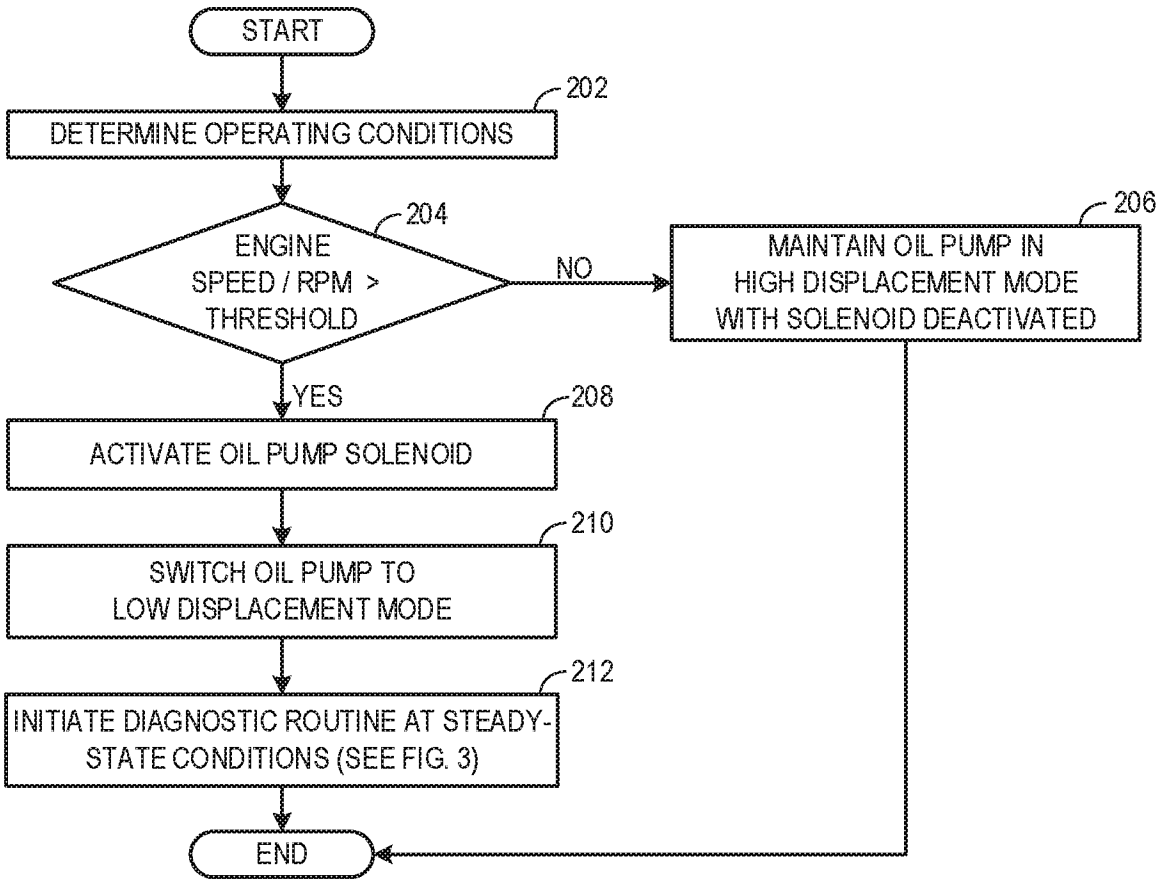
FIG. 2 is a flow chart illustrating an example control routine for operating a variable flow oil pump according to an embodiment of the present disclosure.

Turning to FIG. 2, a method 200 for operating a variable displacement oil pump is illustrated. Instructions for carrying out method 200 and the rest of the methods included herein may be executed by a controller, such as controller 12, based on instructions stored on a memory of the controller and in conjunction with signals received from sensors of the engine system, such as the sensors described above with reference to FIG. 1, in order to control the variable displacement oil pump, such as oil pump 180. The controller may employ various engine actuators of the engine system to adjust engine operation, such as solenoid 190, according to the method described below.

At 202, method 200 includes determining operating conditions. Operating conditions may include engine speed, engine load, vehicle speed, pedal position, throttle position, mass air flow rate, air-fuel ratio, engine temperature, the amount of compressed air in the intake from the turbocharger, oil temperature, etc. At 204, method 200 may determine if the engine speed is greater than a threshold. In one example, a controller of the vehicle may determine the engine speed and may compare it to a speed threshold stored as a pre-determined threshold, to determine if the engine is operating at a speed greater than a threshold. In one example, the engine speed threshold may be 1800 RPM, such that the oil pump may be switched to the low displacement mode at engine speeds commonly exhibited during highway cruising. In other examples, the engine speed threshold may be 2500 RPM or higher, such that the oil pump may be switched to the low displacement mode only during high engine speed excursions, such as during operator tip-ins.

If the engine speed is determined to be below the threshold value (e.g., NO at 204), method 200 may maintain the oil pump in the high displacement mode with the solenoid deactivated at 206. As mentioned earlier, the VDOP may alternate between high displacement and low displacement modes of operation based on engine operating conditions, such as engine speed. For a given value of engine speed, a variable displacement oil pump in the high displacement mode may circulate a mass flow of lubrication oil which is greater than that circulated by the same VDOP in the low displacement mode. Variable oil displacement by the oil pump may be controlled by a spring actuator operably coupled to a solenoid, such as solenoid 190, which may facilitate the changing of displacement modes by the oil pump to deliver variable amounts of oil. In one example, at low engine speeds such as engine speeds below the speed threshold, the solenoid controlling the oil displacement from the VDOP may be at a default, deactivated position and the VDOP may operate at a higher displacement, such that a suitable oil volume may be delivered to the engine for protection/lubrication of engine parts. The default mode of the oil pump may be the high displacement mode (and as such when the solenoid is deactivated, the pump may be in the high displacement mode), so as to avoid engine wear if the solenoid were to degrade. However, other configurations are possible, such as the solenoid being activated to adjust the oil pump to the high displacement mode. Method 200 then returns.

Alternatively, if the engine is determined to be operating at a speed above the threshold (e.g., YES at 204), method 200 may proceed to 208 to activate the oil pump solenoid. Solenoid activation may be directed by the controller, wherein the solenoid may be operably connected to a spring actuator responsible for varying vane length and thereby pump displacement. At 210, method 200 may switch the oil pump to a low displacement mode, via solenoid activation. When activated, the solenoid may adjust the oil pump to a lower displacement to displace a lower amount of oil relative to the high displacement mode, thereby minimizing pumping losses. Thus, fuel consumption by the engine may be reduced and fuel economy may be improved.

Method 200 may then proceed to 212 to initiate a diagnostic routine at steady-state conditions. As one example, the VDOP may function in the low displacement mode at high engine speeds. During this time, if the vehicle is operating with steady-state conditions including one or more of vehicle speed and engine load changing by less than a respective threshold amount, the controller may initiate a diagnostic routine to test the functioning of the VDOP according to the example routine illustrated in FIG. 3. Method 200 then returns.

In this way, based on engine operating conditions such as engine speed, the variable displacement oil pump may be cycled between high and low oil displacement configurations as described in FIG. 2. Specifically, the VDOP may function in a high displacement mode at low engine speeds and be switched to a low displacement mode at high engine speeds, to fulfill engine lubrication and fuel economy demands without sustaining pumping losses.

Figure 3:
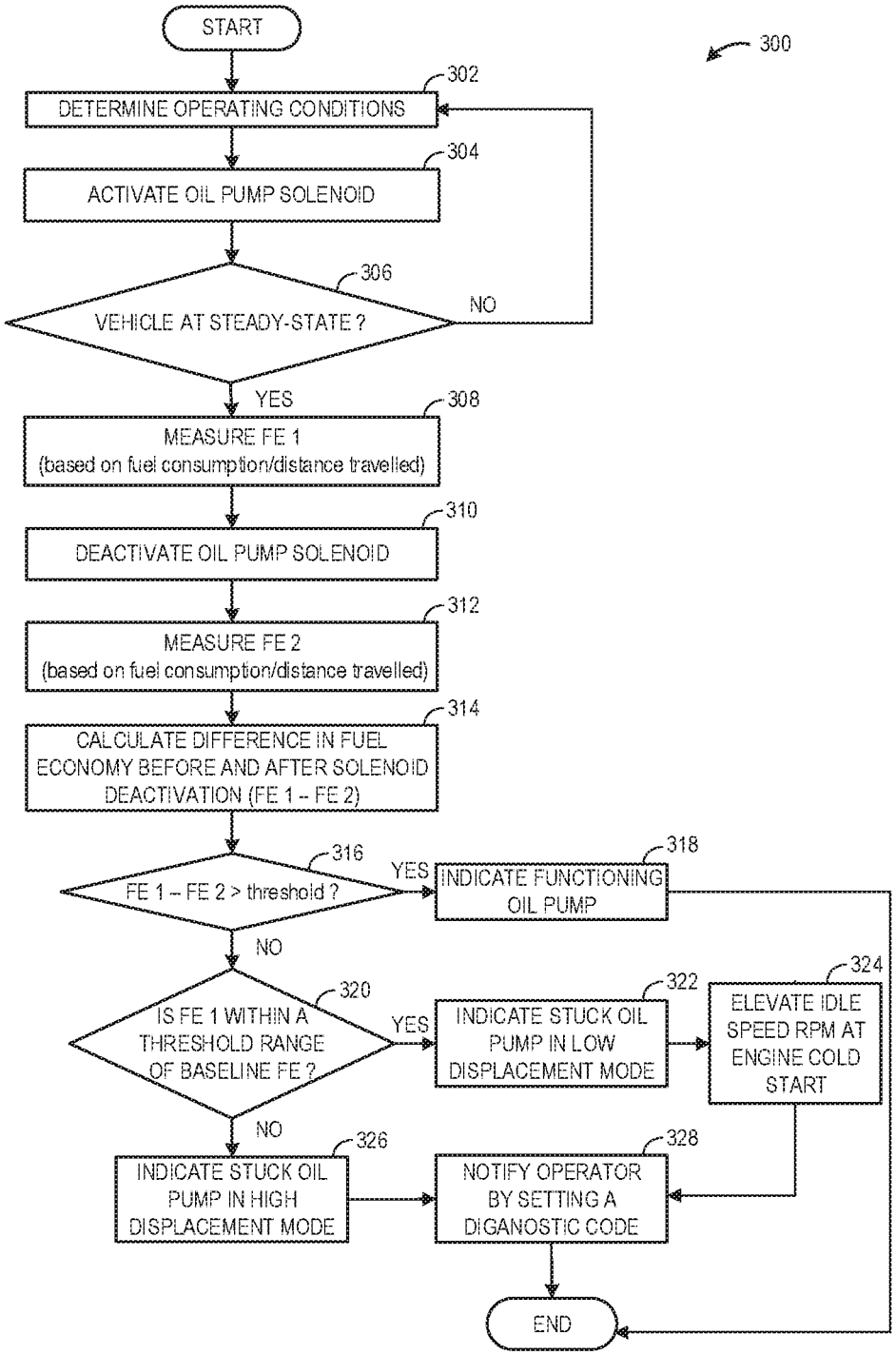
FIG. 3 is a flow chart illustrating a diagnostic routine for diagnosing a variable oil pump stuck in an oil displacement mode, according to an embodiment of the present disclosure.

Turning now to FIG. 3, a flow chart illustrating an example diagnostic method 300 for diagnosing a variable oil pump stuck in an oil flow displacement mode is shown. Method 300 may be carried out by instructions stored in the memory of the controller, such as controller 12, in response to the variable displacement oil pump such as VDOP 180 being operated in a low displacement mode, as described in FIG. 2.

At 302, the method includes determining engine operating conditions. Operating conditions may include engine speed, engine load, vehicle speed, pedal position, throttle position, mass air flow rate, air-fuel ratio, engine temperature, the amount of compressed air in the intake from the turbocharger, oil temperature, etc.

At 304, the method 300 may include activating the oil pump solenoid, such as solenoid 190. The solenoid controlling the oil pump may be operably coupled to the vehicle controller such as controller 12. In one example, oil pump displacement may be actively controlled by adjusting an electrical signal sent to the solenoid according to a software logic control program stored in the memory of the controller. The solenoid may typically be activated at high engine speeds, such that solenoid activation may cause the VDOP to switch to the low displacement mode, thereby minimizing pumping losses and increasing fuel economy. If the solenoid is already activated at high engine speeds as explained with reference to FIG. 2, the method may further include maintaining the solenoid activated.

At 306, the method 300 may include determining if the vehicle is operating under steady-state conditions, for example if the vehicle speed is high and stable and the engine load is steady. In an example, vehicle steady-state operation may comprise the vehicle speed and the engine load changing by less than the respective threshold amounts. For example, vehicle may be operating at a high speed of 60 MPH and the vehicle speed and engine load may be changing by less than 5% over a ten second time period. In another example, the vehicle may be operating with a high speed of 60 MPH and the vehicle speed and engine load may be changing by less than 10% over a twenty second time period. The controller may make a determination of steady-state based on signals received from various sensors of the engine system. For example, the controller may obtain vehicle speed data and engine load data and compare it to pre-determined non-zero positive value speed and load thresholds stored in the memory of the controller. Further, the controller may command switching of the oil pump during first vehicle operating conditions including vehicle speed being above a threshold speed and one or more of engine speed and engine load changing by less than respective threshold amounts. In one example, the oil pump may be switched at each high vehicle speed and steady-state vehicle operating conditions. In another example, the controller may switch the oil pump at pre-determined time intervals or at pre-determined mileage that may further be based on the engine and vehicle operating conditions. Returning to 306, if the engine load is not determined as steady, or the vehicle speed is not high or other such combinations (e.g., NO at 306), method 300 returns to 302 to determine operating conditions.

However, if the vehicle is determined to be operating under steady-state conditions (e.g., YES at 306), method 300 proceeds to 308 to measure a first fuel economy FE 1. Fuel economy (FE) calculations may be based on fuel usage, for example. Fuel economy of the vehicle may also take into account distance traveled by the vehicle (e.g., miles). Thus, the first fuel economy of the vehicle may be calculated based on measured fuel consumption relative to a measured distance traveled, for the vehicle under steady-state conditions. In one example, the fuel economy may be determined based on output from one or more engine sensors, including but not limited to the exhaust oxygen sensor (e.g., sensor 126 of FIG. 1), mass air flow sensor (e.g., sensor 120 of FIG. 1), vehicle odometer, and/or engine speed sensor, as well as fuel usage amounts (which may be determined based on fuel injector pulse width/duty cycle, for example).

In one example, the controller may calculate the first fuel economy at a pre-determined time elapsed after steady-state is reached (e.g., two minutes, ten minutes, etc.) or after a pre-determined mileage (e.g., once every 50 miles, once per trip, etc.), after the vehicle is maintained at steady-state. In another example, the controller may determine engine load and vehicle speed as steady, and then make fuel economy measurements intermittently over a specified time period, wherein an average FE 1 may be calculated for vehicle with the VDOP in the low displacement mode. The FE 1 calculated after solenoid activation with vehicle at steady-state (prior to solenoid deactivation) may be stored in the memory of the controller and may be used to diagnose the functioning of the VDOP, in an example.

Method 300 at 310 may include deactivating the oil pump solenoid, in order to assess the functioning of the oil pump. The solenoid may be deactivated after the first fuel economy has been measured and stored in the memory of the controller. As described earlier, deactivation of the solenoid may cause the VDOP to change from a first, low displacement mode to a second, high displacement mode. Mode switching to high displacement of the oil pump during the high speed engine conditions may displace more oil volume than if the pump were operating at low displacement, resulting in an expected change (e.g., a decrease) in the measured fuel economy of the vehicle, in one example.

At 312, method 300 may include measuring a second fuel economy FE 2. The second fuel economy may be measured by calculating fuel consumption relative to distance traveled, following solenoid deactivation. The controller may calculate the fuel economy at a pre-determined time or mileage or alternatively measure fuel economy intermittently over a specified time period, and calculate an average FE 2 for the vehicle operating with the oil pump at high displacement.

At 314, method 300 may include calculating a difference in the fuel economy before and after solenoid deactivation. For example, a difference between the first fuel economy and the second fuel economy (FE 1-FE 2) may be calculated.

At 316, method 300 may determine if the difference in the fuel economy before and after solenoid deactivation (FE 1-FE 2) is greater than a threshold difference. The threshold difference may be a non-zero positive value threshold difference, representing a difference in fuel economy below which the functioning of the VDOP may be degraded. In one example, the threshold difference may be three miles per gallon (MPG). In another example, the threshold difference may be a relative difference such as a change in fuel economy of 5% or 10%. A vehicle with a functioning oil pump operating with low displacement may displace a relatively smaller amount of oil, thereby abating pumping losses and reducing fuel consumption at high engine speeds, leading to increased fuel economy, measured as the first fuel economy FE 1. In contrast, when commanded by the controller to operate at high displacement, the oil pump may displace a relatively larger amount of oil. Higher oil displacement may lead to a decrease in the fuel economy of the vehicle, measured as the second fuel economy FE 2. In the example of a functioning oil pump (e.g., not degraded oil pump), the difference in the fuel economy before and after solenoid deactivation (FE 1-FE 2) will be greater than the threshold difference. Thus, if method 300 determines the change in the fuel economy (FE 1-FE 2) is greater than the threshold difference at 316, then the method moves to 318 and indicates a functioning oil pump. Method 300 then returns.

However, if at 316 method 300 determines that the change in fuel economy (FE 1-FE 2) is not greater than the threshold difference, then the method moves to 320 to further determine if FE 1 is within a threshold range of a baseline FE. The baseline FE may represent the fuel economy of the vehicle during optimal or standard fuel economy measurement conditions, such as when the vehicle is travelling at 60 MPH on level ground (e.g., such that engine load is low and not changing). The baseline FE value may be determined by the controller and the baseline fuel economy may be stored in the memory of the vehicle controller. The baseline FE may be determined prior to the commanded change in pump displacement (from low to high displacement) while the vehicle is operating with the first vehicle operating conditions. In some examples, the baseline FE may be determined at the time of vehicle manufacture. Additionally or alternatively, the baseline FE may be determined or updated over the lifetime of the vehicle to account for changes to the fuel economy as vehicle components wear. In either example, the baseline FE may be determined when the oil pump is known to be functional and/or may be determined when the oil pump is in the low displacement mode. The threshold range of the baseline FE may be 3%-5% of the baseline fuel economy and may be stored in the memory of the controller.

If the first fuel economy FE 1 is determined to be within the threshold range of the baseline fuel economy (e.g., YES at 320), method 300 at 322 indicates the oil pump is stuck in the low displacement mode. The oil pump may be indicated as stuck in low displacement mode based on the first fuel economy FE 1 being within a threshold range of the baseline fuel economy (e.g., within a 3%-5% range of the baseline FE measured) and further based on the difference between the first fuel economy and the second fuel economy (FE 1-FE 2) being less than the threshold difference.

The first fuel economy being within the threshold range of the baseline fuel economy at vehicle high speed and steady-state operation indicates the VDOP is operating in the low displacement mode. Upon the commanded change in pump displacement, the second fuel economy measured would be expected to change if the oil pump is not degraded. If the first fuel economy (measured with pump commanded to low displacement, with the solenoid active) and the second fuel economy (measured with pump commanded to high displacement, with the solenoid deactivated) are similar, e.g., the difference between the first fuel economy and the second fuel economy (FE 1-FE 2) is less than the threshold difference, then the oil pump is determined to be stuck (e.g., stuck in a certain displacement mode). Because the first fuel economy FE 1 is determined to be within the threshold range of the baseline fuel economy, the oil pump is confirmed as being stuck in the low displacement mode, as further illustrated in FIG. 4.

Upon diagnosing the oil pump as being stuck in the low displacement mode, method 300 may proceed to 324 to elevate idle engine speed. In one example, responsive to the indication that the oil pump is stuck in the low displacement mode, the controller may increase the engine idle speed of the vehicle wherein the engine idle speed may comprise a speed at which the engine is controlled to operate at during idle engine conditions. For example, during engine idle conditions (e.g., where the engine is operating but the vehicle is not being propelled by the engine due to the engine being uncoupled from the vehicle drivetrain), an idle engine throttle may be controlled to a given position to maintain engine speed at a commanded idle speed. When the oil pump is not degraded, the commanded idle speed may be 500 RPM in one non-limiting example. If the oil pump is determined to be stuck in the low displacement mode, the commanded idle speed may be increased to 1000 RPM, in a non-limiting example. The increased commanded idle speed may result in the idle engine throttle being controlled to a more-open position and/or the increased commanded idle speed may result in the intake throttle being controlled to a more-open position during idle. At 328, method 300 includes notifying an operator of the vehicle of the degraded oil pump and/or setting a diagnostic code indicative of the degraded oil pump. For example, an operator may be notified by illuminating an indicator on the vehicle instrument panel alerting the vehicle operator of the received notification. Method 300 then returns.

Returning back to 320, if the first fuel economy FE 1 is not determined to be within a threshold range of the baseline fuel economy (e.g., NO at 320), method 300 at 326 includes indicating the oil pump is stuck in the high displacement mode. The oil pump may be indicated as stuck in high displacement mode (e.g., degraded) based on the first fuel economy FE 1 not being within a threshold range of the baseline fuel economy and further based on the difference between the first fuel economy and the second fuel economy (FE 1-FE 2) being less than the threshold difference.

For example, the first fuel economy being outside the threshold range of the baseline fuel economy (not within 3%-5% as an example) at vehicle high speed and steady-state conditions indicates the VDOP is not operating in the low displacement mode when the solenoid is active, as would be expected if the oil pump were not degraded. Further, upon the commanded change in pump displacement, the second fuel economy measured would be anticipated to change if the oil pump were not degraded. If the first fuel economy and the second fuel economy are determined to be similar, e.g., the difference between the first fuel economy and the second fuel economy (FE 1-FE 2) is less than the threshold difference, then the oil pump is determined as stuck. Because the first fuel economy FE 1 is not within a threshold range of the baseline fuel economy, the oil pump may be confirmed as stuck in the high displacement mode, as further illustrated in FIG. 5.

Upon diagnosing the oil pump as being stuck in the high displacement mode, method 300 may proceed to 328 and notify an operator of the vehicle that the oil pump is degraded and/or set a diagnostic code indicative of the oil pump being degraded. For example, an operator may be notified by illuminating an indicator on the vehicle instrument panel alerting the vehicle operator of the received notification. Method 300 then returns.

In this way, a commanded change in displacement of the oil pump may result in a measurable change in the fuel usage by the vehicle, thereby affecting fuel economy. Based on a comparison of the second fuel economy measured after solenoid deactivation to baseline fuel economy and/or a first fuel economy measured while solenoid is active, a diagnosis of degradation of the VDOP function may be indicated.

Degradation of the oil pump may be indicated responsive to a difference between the first fuel economy and the second fuel economy being less than a first threshold difference and the first fuel economy being within a second threshold range of the baseline fuel economy. In this way, the oil pump may be indicated as stuck in the low displacement mode.

Degradation of the oil pump may be also be indicated responsive to a difference between the first fuel economy and the second fuel economy being less than a first threshold difference and the first fuel economy being outside of a second threshold range of the baseline fuel economy. In this way, the oil pump may be indicated as stuck in the high displacement mode.

In some examples, rather than measuring fuel economy before and after the commanded change in oil pump displacement in order to determine if the oil pump is degraded, method 300 may additionally or alternatively utilize other mechanisms for measuring fuel usage, such as an absolute volume of fuel consumed, a duty cycle of the fuel injectors of the engine, or other fuel usage metric.

FIG. 4 shows a first graphical example 400 of operating parameters during a diagnosis of a variable displacement oil pump based on fuel economy. The graphs represented are time aligned and occur at the same time. The horizontal (x-axis) denotes time and the vertical markers t1-t3 identify times during which a commanded change in displacement of a variable displacement oil pump occurs. The first graph from the top shows fuel economy that may be calculated by the vehicle controller based on a fuel usage relative to distance traveled by the vehicle. The solid plot 404 depicts an expected fuel economy for functioning non-degraded oil pump, while the dotted plot 402 depicts fuel economy for an oil pump stuck in the low displacement mode. The second graph from the top shows plot 406 depicting vehicle speed during engine operation. The third graph from the top shows plot 408 depicting a status of the oil pump solenoid. The fourth graph from the top is a plot 410 illustrating engine speed for a vehicle with a non-degraded oil pump and plot 412 illustrating engine speed for a vehicle with an oil pump stuck in the low displacement mode.

At time t1, the vehicle may be traveling at a relatively high speed as shown by plot 406, for example the vehicle may be traveling at a speed of 60 MPH. As such, this may result in an engine speed greater than a threshold (as shown by plot 410 being above the dashed line, which is indicative of the threshold engine speed). In response to engine speed being above the threshold, the controller may activate the oil pump solenoid (plot 408), in accordance with the example control routine for operating a variable flow oil pump as described in FIG. 2. When activated, the solenoid may cause the variable oil pump to operate at a lower, first displacement. Thus, between time t1-t2, the vehicle may maintain traveling at high speed (plot 406) and the active solenoid may cause the oil pump to operate in the low displacement mode. As a result, less oil may be pumped to the engine than if the oil pump were operating in the high displacement mode, leading to the relatively high fuel economy observed during t1-t2 (plot 404).

In order to verify the oil pump is functioning as expected, the vehicle controller may be configured to carry out a diagnostic routine, in accordance with FIG. 3 described above. The controller may determine if the vehicle is operating at steady-state speed and load based on signals from various sensors of the engine system (e.g., based on output from Hall effect sensor 118 and/or MAF sensor 120). In an example, vehicle steady-state operation may comprise the vehicle speed and the engine load changing by less than the respective threshold amounts. Once the steady-state determination is made, the controller may calculate a first fuel economy of the vehicle between t1-t2 (plot 404). As one example, a series of fuel economy values may be calculated based on fuel usage relative to distance traveled and an average fuel economy may be calculated. As another example, a first fuel economy may be calculated at a pre-determined amount of time elapsed after vehicle steady-state operation is reached.

At time t2, when the steady-state operation of the vehicle continues (plot 406), the controller may command a change in the displacement of the oil pump. For example, the oil pump may be commanded to operate at a higher, second displacement by deactivating the solenoid (plot 408). As explained above, operation of the oil pump at the higher displacement while the vehicle is operating at high engine speeds may result in pumping losses. Thus, for a functional oil pump that is commanded to operate with high displacement while vehicle speed is high and steady, fuel economy may be adversely affected (plot 404).

After solenoid deactivation at t2, the controller may calculate a second fuel economy of the vehicle between t2-t3 while steady state operation is maintained. At t3, the controller may subsequently calculate a change from the first (between t1-t2) to the second (between t2-t3) fuel economy. As mentioned earlier, a functional oil pump that is commanded to operate at high displacement while vehicle speed is high and steady may be negatively affected in its fuel economy. If the calculated change in fuel economy is greater than a threshold difference, as a result of low fuel economy observed during t2-t3 (plot 404), then the oil pump is indicated as not degraded (e.g., the oil pump is operable to switch between the low displacement mode and the high displacement mode responsive to activation or deactivation of the solenoid).

However, if the calculated change in fuel economy is less than a threshold difference, as a result of fuel economy not changing upon the commanded change in oil pump displacement between time t2-t3 (plot 402) when compared to t1-t2, then the oil pump may be stuck in one of the displacement modes.

To differentiate between the pump being stuck in the low displacement mode and the pump being stuck in the high displacement mode, the controller may further compare the calculated first fuel economy to a baseline fuel economy, estimated at a prior steady-state operation of the vehicle and further stored in the memory of the controller. While the baseline fuel economy is not specifically illustrated in FIG. 4, the baseline fuel economy may be determined during conditions equivalent to the conditions during which the diagnostic routine is carried out (e.g., while the vehicle is travelling at 60 MPH on level ground and with the solenoid activated). Thus, the fuel economy prior to time t2 shown by plot 404 may be an approximation of the baseline fuel economy.

As shown, the first fuel economy (of plot 402) may be substantially equal to the baseline fuel economy, wherein substantially equal comprises within a threshold range of baseline, such as within 5% of baseline fuel economy. Accordingly, because the first fuel economy is within the threshold range of the baseline fuel economy and the difference between the first fuel economy and the second fuel economy is less than the threshold difference, the oil pump is determined to be stuck in the low displacement mode. A pump stuck in low displacement while the vehicle is operating at high speeds may have an adverse effect on engine components. In the event of a stuck pump displacing less than adequate oil volume, the controller may command an increase in engine idle speed so as to pump more oil to the engine at idle condition for enhanced lubrication of engine parts.

At t3, the diagnosis of whether the oil pump is functioning vs. Stuck in low displacement has concluded. Because the vehicle continues to operate at steady-state with higher than threshold speed (plot 406), the controller may activate the oil pump solenoid (plot 408) to operate the oil pump in the low displacement mode, resulting in improved fuel economy of the vehicle (plot 404). However, at least in some examples, when the oil pump is determined to be stuck in the low displacement mode, the controller may not activate the solenoid even when engine speeds are higher than the threshold that typically causes the oil pump to switch to the low displacement mode. Because the oil pump will operate in the low displacement mode regardless of solenoid activation, the controller may cease activation of the solenoid to avoid wasting energy.

Around time t4, the vehicle begins to decelerate and eventually comes to a stop. At t4, the engine speed drops below the threshold speed. As a result, the solenoid is deactivated so that the oil pump is returned to the low displacement mode. As the vehicle comes to a stop (e.g., the vehicle is not propelled by the engine), the engine operates at idle speed. When the oil pump is not degraded, the engine may operate at a first, lower commanded idle speed, as shown by plot 410. However, if the oil pump is stuck in the low displacement mode, the engine may operate at a second, higher commanded idle speed, as shown by plot 412. By doing so, sufficient oil may be supplied to the engine even if the pump is stuck in the low displacement mode.

In this way, degradation of an oil pump may be indicated based on a fuel economy of the vehicle. Specifically, the oil pump may be indicated as stuck in the low displacement mode when the first fuel economy is within a threshold range of the baseline fuel economy along with a difference between the fuel economy with the pump commanded to operate at a first, lower displacement mode and the fuel economy with the pump commanded to operate at a second, higher displacement mode being less than a threshold difference.

FIG. 5 shows a second graphical example 500 of operating parameters during a diagnosis of a variable displacement oil pump based on fuel economy. The graphs represented are time aligned and occur at the same time. The horizontal (x-axis) denotes time and the vertical markers t1-t3 identify times during which a commanded change in displacement of a variable displacement oil pump occurs. The first graph from the top shows fuel economy that may be calculated by the vehicle controller based on a fuel usage relative to distance traveled by the vehicle. The solid plot 502 depicts an expected fuel economy for a functioning, non-degraded oil pump, while the dotted plot 504 depicts fuel economy for an oil pump stuck in the high displacement mode. The second graph from the top shows plot 506 illustrating vehicle speed during engine operation. The third graph from the top shows plot 508 depicting an active vs. Inactive state of the oil pump solenoid. The fourth graph from the top is a plot 510 illustrating engine speed.

At time t1, the vehicle may be traveling at a relatively high speed as shown by plot 506, for example the vehicle may be traveling at a speed of 60 MPH. As such, this may result in an engine speed greater than a threshold (as shown by plot 510 being greater than the dashed line, which represents the threshold speed). In response to engine speed being above the threshold, the controller may activate the oil pump solenoid (plot 508), in accordance with the example control routine for operating a variable flow oil pump as described in FIG. 2. When activated, the solenoid may cause an adjustment of the oil pump displacement. For example, the solenoid may cause the variable oil pump to operate at a lower, first displacement. Thus, between time t1-t2, the vehicle may maintain traveling at high speed (plot 506) and the active solenoid may cause the oil pump to displace a lower oil volume relative to if the oil pump were operated in the high displacement mode. As a result, improved fuel economy may be observed (plot 502).

In order to verify that the oil pump is functioning as expected, the vehicle controller may carry out a diagnostic routine, such as FIG. 3 described earlier. The controller may first determine if the vehicle is operating at steady-state based on signals obtained from various sensors of the engine system. In an example, vehicle steady-state operation may comprise the vehicle speed and the engine load changing by less than the respective threshold amounts. Once the steady-state determination is made, the controller may calculate a first fuel economy of the vehicle between t1-t2 (plot 502 and plot 504). As one example, a series of fuel economy values may be calculated based on fuel usage relative to distance traveled and an average fuel economy calculated. As another example, a first fuel economy may be calculated at a pre-determined amount of time elapsed after vehicle steady-state is reached.

At time t2, when the vehicle continues to operate in steady-state at high speed (plot 506), the controller may command a change in the displacement of the oil pump. For example, the oil pump may be commanded to switch to high displacement by deactivating the solenoid (plot 508). Between time t2-t3, deactivation of the solenoid may result in the oil pump displacing more than a demanded oil volume, causing pumping losses. As a result, fuel economy may be negatively affected (as observed by the drop in plot 502).

When the solenoid is deactivated (during t2-t3), the controller may calculate a second fuel economy of the vehicle between t2-t3. At t3, the controller may subsequently calculate a change from the first (between t1-t2) to the second (between t2-t3) fuel economy. As mentioned earlier, a functional oil pump that is commanded to operate at high displacement while vehicle speed is high and steady may be negatively affected in its fuel economy. If the calculated change in fuel economy is greater than a threshold difference, as a result of high fuel economy during t1-t2 (plot 502) changing to low fuel economy during t2-t3 (plot 502), then the oil pump is functioning as expected and concluded as not degraded.

However, if the calculated change in fuel economy is less than a threshold difference because of low fuel economy measured during t1-t2, e.g., the fuel economy during t2-t3 compared to the fuel economy during t1-t2 (for dotted plot 504), then the oil pump may be indicated as stuck (e.g., stuck in a certain displacement). The stuck oil pump may be diagnosed from the low fuel economy that remains unchanged despite the change from an activated to a deactivated state of the solenoid, as seen during t1-t3. The controller may further compare the calculated first fuel economy (t1-t2) to a baseline fuel economy (not shown, but as explained above may be approximated by the fuel economy of plot 502 from t1-t2), wherein the baseline fuel economy may be estimated at a prior steady-state of the vehicle and further stored in the memory of the controller.

In one example, the first fuel economy (plot 502) may be substantially equal to the baseline fuel economy, wherein substantially equal comprises within a threshold range of baseline, such as within 5% of baseline fuel economy. A first fuel economy being within a threshold range of the baseline fuel economy and a difference between the first and the second fuel economy being greater than a threshold difference, together may indicate the oil pump as not degraded.

However, in another example, the first fuel economy (plot 504) may be outside (not within) a threshold range of the baseline fuel economy. In the event of the first fuel economy being outside of a threshold range of the baseline fuel economy, together with a difference between the first and the second fuel economy being less than a threshold difference being observed, an oil pump stuck in high displacement may be indicated.

At t3, the controller may have concluded the diagnosis of whether the oil pump is functioning vs. Stuck in high displacement. The controller may once again determine if the vehicle steady-state operation continues with higher than threshold speed (plot 506). If the vehicle is operating at steady-state conditions with high speed, then accordingly, the controller may activate the oil pump solenoid (plot 508) to operate the oil pump in low displacement, resulting in improved fuel economy of the vehicle (plot 502). Alternatively, if the oil pump is diagnosed as stuck in high displacement, then the fuel economy measured at or after t3 would continue to be low, as shown by plot 504.

Around time t4, the vehicle begins to decelerate and eventually comes to a stop. At t4, the engine speed drops below the threshold speed. As a result, the solenoid is deactivated so that the oil pump is returned to the low displacement mode. As the vehicle comes to a stop (e.g., the vehicle is not propelled by the engine), the engine operates at idle speed. When the oil pump is not degraded, the engine may operate at a first, lower commanded idle speed, as shown by plot 510. Likewise, if the oil pump is stuck in the high displacement mode, the engine may operate at the same first commanded idle speed. In some examples, due to the change in engine operation (e.g., to lower engine speeds) after t4, the fuel economy of the vehicle when the oil pump is stuck in the high displacement mode (as shown by plot 504) may increase. As such, the fuel economy penalty for the vehicle operating with the oil pump stuck in the high displacement mode may only be observed during higher engine speed conditions.

In this way, degradation of an oil pump may be indicated based on a fuel economy response of the vehicle. Specifically, the oil pump may be indicated as being stuck in high displacement mode when the first fuel economy is outside of a threshold range of the baseline fuel economy along with a difference between the fuel economy with the pump commanded to operate at a lower displacement and fuel economy with the pump commanded to operate at a higher displacement, being less than a threshold difference. For a vehicle having an oil pump stuck in the high displacement mode, the resulting fuel economy may be poor but the high flow of oil may provide adequate lubrication and protection for the engine. Thus, by a simple and reliable monitoring of fuel economy of a vehicle, it may be possible to detect a degraded and stuck oil pump.

The technical effect of performing a diagnostic routine for a variable displacement oil pump in an engine system is that a degraded oil pump may be identified. By measuring fuel economy of a vehicle operating at steady-state, responsive to a change in displacement of the oil pump via a solenoid actuator, an oil pump that may be stuck in low displacement may be distinguished from an oil pump that may be stuck in high displacement.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine of a vehicle, comprising:

indicating a variable displacement oil pump is stuck in a low displacement mode based on a change in fuel economy of the engine being less than a threshold change following a commanded change in displacement of the oil pump, and further based on an average fuel economy following the commanded change in displacement being substantially equal to a baseline fuel economy; and increasing a commanded engine idle speed based on the indication that the oil pump is stuck in the low displacement mode.

2. The method of claim 1, wherein the commanded change in displacement occurs during first vehicle operating conditions that comprise vehicle speed above a threshold vehicle speed and one or more of engine speed and engine load changing by less than a respective threshold amount, and wherein the baseline fuel economy is determined prior to the commanded change in displacement while the vehicle is operating with the first vehicle operating conditions.

3. The method of claim 2, further comprising commanding the change in displacement of the oil pump by deactivating a solenoid of the oil pump, the solenoid configured to displace a spring when activated, the spring causing one or more internal rotors of the oil pump to pivot when displaced by the solenoid, and wherein the baseline fuel economy is determined while the solenoid of the oil pump is activated.

4. The method of claim 3, further comprising, upon indicating that the oil pump is stuck in the low displacement mode, maintaining the solenoid deactivated even when vehicle speed is above the threshold vehicle speed, and further comprising indicating that the oil pump is not degraded responsive to the change in fuel economy of the engine being more than the threshold change following the commanded change in displacement of the oil pump.

5. The method of claim 1, wherein the commanded engine idle speed comprises an engine speed the engine is controlled to operate at when the engine is operating and the vehicle is not propelled by the engine.

6. The method of claim 1, further comprising indicating that the oil pump is stuck in a high displacement mode based on the change in fuel economy of the engine being less than the threshold change following the commanded change in displacement of the oil pump, and further based on the average fuel economy following the commanded change in displacement being less than the baseline fuel economy.

7. The method of claim 1, further comprising notifying an operator and/or setting a diagnostic code based on the indication that the oil pump is stuck in the low displacement mode.

8. The method of claim 1, wherein increasing the commanded engine idle speed comprises adjusting one or more of an idle throttle and an intake throttle to a more-open position during engine idle conditions.

* * * * *